US008056235B1

(12) United States Patent
Briggs et al.

(10) Patent No.: US 8,056,235 B1
(45) Date of Patent: Nov. 15, 2011

(54) PROCESS FOR PRODUCING A RAIL AND POST FENCE SYSTEM

(75) Inventors: Earl Benton Briggs, Fort Gibson, OK (US); Dean Barkley Briggs, Fort Gibson, OK (US); David Bryan Sherwood, Sapulpa, OK (US)

(73) Assignee: Master Coil, LLC, Fort Gibson, OK (US)

( * ) Notice: Subject to any disclaimer, the term of this patent is extended or adjusted under 35 U.S.C. 154(b) by 241 days.

(21) Appl. No.: 12/536,965

(22) Filed: Aug. 6, 2009

Related U.S. Application Data

(63) Continuation-in-part of application No. 11/758,356, filed on Jun. 5, 2007, now Pat. No. 7,690,629.

(51) Int. Cl.
*B21D 47/00* (2006.01)
*E04H 17/00* (2006.01)

(52) U.S. Cl. ..... 29/897.31; 29/897.312; 29/897.32; 29/521; 29/525.01; 29/527.1; 256/65.12

(58) Field of Classification Search ..... 29/897.31, 29/897.312, 424, 428, 521, 525.01, 527.1; 256/65.12, 21, 59
See application file for complete search history.

(56) References Cited

U.S. PATENT DOCUMENTS

| | | | | |
|---|---|---|---|---|
| 236,755 | A | 1/1881 | Banks | |
| 1,900,721 | A | 3/1933 | Manske et al. | |
| 1,946,694 | A | 2/1934 | Hunter | |
| 2,241,952 | A * | 5/1941 | Lachman | 52/668 |
| 2,934,180 | A | 4/1960 | Hammitt et al. | |
| 3,122,355 | A | 2/1964 | Richardson | |
| 3,338,602 | A | 8/1967 | Arnd | |
| 3,608,938 | A | 9/1971 | Murdock | |
| 3,770,245 | A | 11/1973 | Murdock | |
| 3,822,053 | A | 7/1974 | Baily | |
| 4,007,919 | A | 2/1977 | Totten | |
| 4,010,589 | A | 3/1977 | Gross | |
| 4,014,520 | A | 3/1977 | Walters | |
| 4,140,298 | A | 2/1979 | Coleman, Jr. | |
| 4,162,861 | A * | 7/1979 | Reid et al. | 403/242 |
| 4,180,247 | A | 12/1979 | Pfarr, Jr. | |
| 4,468,067 | A | 8/1984 | Jenkins | |
| 4,476,658 | A | 10/1984 | Johnstone | |
| RE33,566 | E | 4/1991 | Heckelsberg | |
| 5,150,885 | A | 9/1992 | Leone | |
| 5,494,261 | A | 2/1996 | Gandara | |
| 5,689,990 | A | 11/1997 | Deeley | |
| 5,873,564 | A | 2/1999 | Bisch | |
| 5,899,035 | A * | 5/1999 | Waalkes et al. | 52/239 |
| 6,042,296 | A | 3/2000 | Wittig et al. | |
| 6,135,425 | A | 10/2000 | Platt | |
| 6,183,879 | B1 | 2/2001 | Deeley | |

(Continued)

*Primary Examiner* — Jermie Cozart
(74) *Attorney, Agent, or Firm* — Head, Johnson & Kachigian, P.C.

(57) ABSTRACT

A modular rail and post fence system which may be fabricated, assembled, and installed without fasteners, adhesives or welding. The fence system includes a plurality of rail assemblies with each rail assembly formed from a pair of panels. Each panel has a pair of sidewalls joined together at an angle to form an angled edge wherein the pair of panels are joined together to form a rail assembly. A plurality of elongated posts are also provided. Each elongated post has at least one longitudinal recess. At least one pair of notches in the pair of longitudinal recesses is provided whereby the angled edges of each rail assembly are received in one pair of notches of the elongated posts.

12 Claims, 9 Drawing Sheets

U.S. PATENT DOCUMENTS

| | | | | |
|---|---|---|---|---|
| 6,305,671 | B1 | 10/2001 | Valentine | |
| 6,375,166 | B1 | 4/2002 | Schall et al. | |
| 6,499,725 | B2 | 12/2002 | Meis et al. | |
| 6,631,887 | B1 | 10/2003 | Walmsley | |
| 6,775,951 | B2 | 8/2004 | Gumpert et al. | |
| 6,824,123 | B2 | 11/2004 | Larsen et al. | |
| 7,025,335 | B2 | 4/2006 | Zhu | |
| 7,090,201 | B2 | 8/2006 | Brucker | |
| 7,341,242 | B2 | 3/2008 | Bertato | |
| 7,634,882 | B1 | 12/2009 | Briggs et al. | |
| 2007/0214856 | A1 * | 9/2007 | Williams | 72/253.1 |

* cited by examiner

PROCESS FOR PRODUCING A RAIL AND POST FENCE SYSTEM

CROSS-REFERENCE

This application is a continuation-in-part patent application of U.S. patent application Ser. No. 11/758,356 filed Jun. 5, 2007, now U.S. Pat. No. 7,690,629 B1 incorporated in its entirety herein by reference.

BACKGROUND OF THE INVENTION

1. Field of the Invention

The present invention relates to a modular rail and post fence system that may be constructed and assembled without any fasteners, adhesives or soldering. In particular, the present invention is directed to both a decorative and structural modular rail and post fence system wherein a small number of post components may be chosen to form a wide variety of post configurations. The modular rail and post fence system may be roll formed from conventional flat metal pieces, may be shipped in component parts for storage and may be distributed and shipped to locations in the field for assembly.

2. Prior Art

Various types of rail fencing systems have been proposed in the past. In a typical system, a plurality of posts and a plurality of rails are manufactured and then shipped to distribution or sales points. The individual components are then shipped to the installation location where the posts are installed and the rails are attached to the posts by fasteners. Decreasing the costs associated with shipping and storage is desirable.

In an effort to provide modular fence systems and to ease installation, various types of connection mechanisms have been proposed in the past.

Arnd (U.S. Pat. No. 3,338,602) discloses a pair of tubular shaped pieces 1 and 2 having a square cross section which are joined together. Connecting member 3 with a flexible projection 4 joins the tubular pieces together.

Murdock (U.S. Pat. No. 3,608,938) discloses a fence system with tubular rails 36. Connectors 41 extending from fence post 12 are received in the open ends of rails 36.

Jenkins (U.S. Pat. No. 4,468,067) discloses a display case with rail horizontal member 24 which is pinned to post frame member 14 by a hook member 60 received in open end 62 of rail 24.

Bisch (U.S. Pat. No. 5,873,564) in FIGS. 17 through 19, discloses a metal fence with a rail 204 which is held to a frame by elastic, spring-like pin 210.

Wittig et al. (U.S. Pat. No. 6,042,296) discloses a variety of panel fasteners. FIG. 11 discloses a fastener 500 with legs 513a and b to lock an adjoining panel. Ends 530a and b include caroming surfaces 580a and b and locking surfaces 582a and b.

Walmsley (U.S. Pat. No. 6,631,887) in FIG. 6, discloses a rail 66 with side edges turned inward.

A number of proposals in the past have suggested eliminating conventional fasteners to secure rails to posts, for example, Schall et al. (U.S. Pat. No. 6,375,166). Banks (U.S. Pat. No. 236,755) discloses a metal tubular fence system wherein the rails are assembled without fasteners although the fence posts must be soldered together. There, nevertheless, remains a need to produce a rail and post fence system that eliminates the need for any fasteners, either in manufacturing or assembling.

There have also been known snap lock joint connections for metal panels, such as button punch or Pittsburgh lock connections.

It would also be desirable to be able to store and to ship the rails and posts and components thereof in nested fashion to reduce shipping space and shipping costs.

Accordingly, it is a principal object and purpose of the present invention to provide a modular rail and post fence system which may be constructed, assembled, and installed without use of any fasteners, any adhesives or any soldering.

It is a further object and purpose of the present invention to provide a modular rail and post fence system wherein the individual components may be roll formed from flat sheets of metal.

It is a further object and purpose of the present invention to provide posts formed of a pair of panels or components so that a small number of post panels or components may be selectively chosen to form a wide variety of post configurations.

It is a further object and purpose to provide a modular rail and post fence system with hollow post and rails that may be filled with initially liquid material that cures to a solid to form a structural fence system.

It is a further object and purpose to provide a decorative modular rail and post fence system that may be simply converted to a structural fence system.

It is a further object and purpose of the present invention to provide a modular rail and post fence system wherein the individual components may be nested together for savings on shipping, transportation and storage.

It is a further object and purpose to provide a modular rail and post fence system with adaptors between rail and post components to accommodate uneven ground conditions.

SUMMARY OF THE INVENTION

The present invention is directed to a modular rail and post fence system which may be both manufactured and assembled in the field without any fasteners, adhesives or soldering. The modular fence system includes a plurality of rail assemblies, each of which are similar in construction, and a plurality of elongated posts that may be selectively configured.

Each elongated post includes at least one longitudinal recess. At spaced positions along the longitudinal recess of the elongated post, pairs of opposed notches are provided to allow selective installation and placement of the rail assemblies.

Each rail assembly is formed from a pair of panels. Each rail panel has a pair of flat sidewalls which are joined together at an angle to form an angled edge. One rail panel has a first side terminating in an opening having a hook and an opposed second side terminating in an opening having a hook. The other rail panel has opposed sides with flat edges. The pair of panels are joined together to form a hollow rail assembly.

In one preferred configuration, each elongated post is composed of a pair of elements. Each of the post elements includes a first end which terminates in a crimp to form an opening having a hook and a second end terminating in a plurality of button protrusions.

In order to install a rail assembly into an elongated post, one end of the rail assembly is inserted into the pair of notches in the longitudinal recess of the post. The rail assembly may be compressed slightly and inserted into the recess until the rail assembly is received into the pair of opposed notches.

In the event that the installation location is uneven so that the rails will not be perpendicular to the posts, a rotatable adaptor may be used between the post and rail assembly.

As a further option, initially liquid foam may be inserted into the posts and rail assemblies of the modular rail and post fence system to provide structural integrity.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
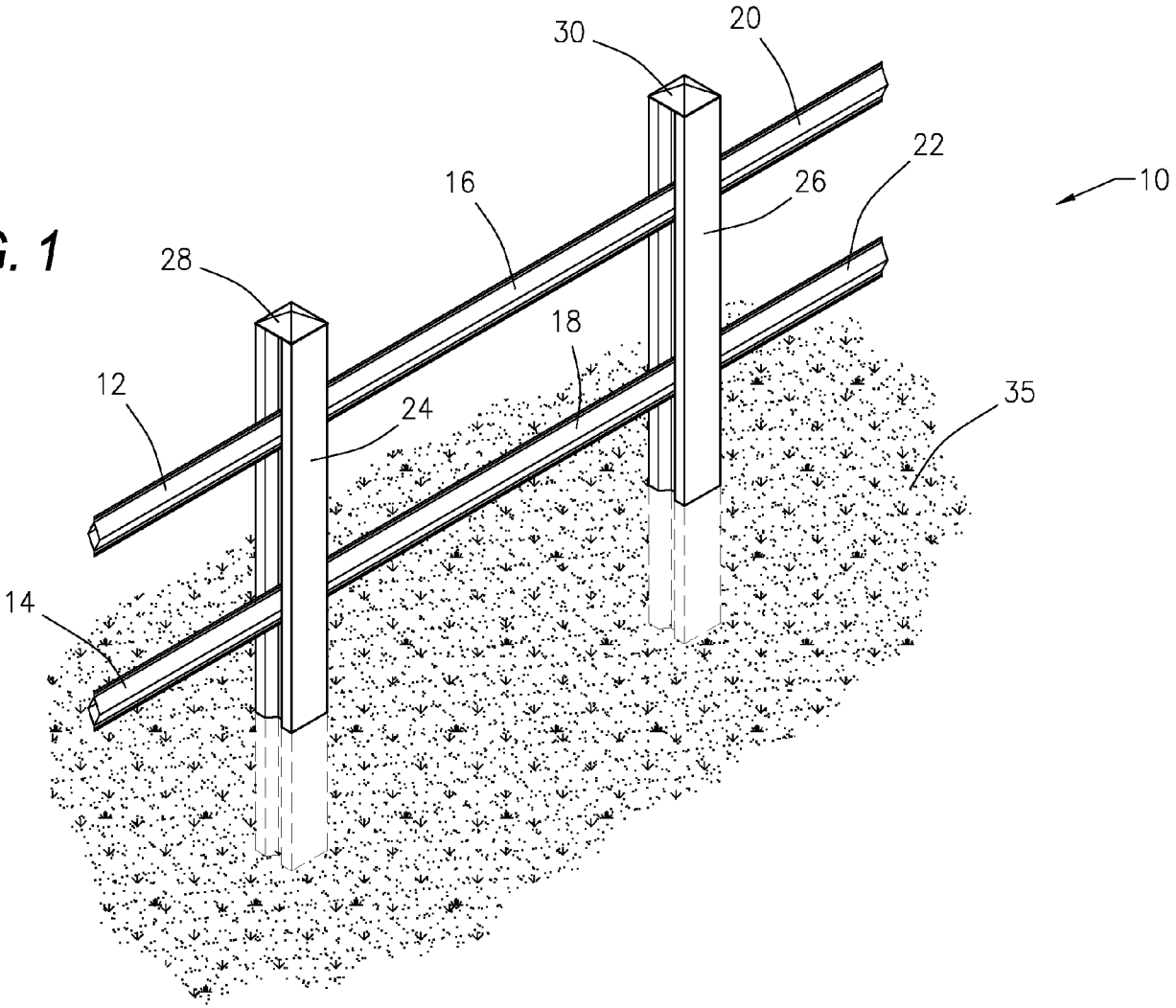
FIG. 1 is a perspective view of a modular rail and post fence system which has been assembled and constructed in accordance with the present invention.

Referring to the drawings in detail, FIG. 1 illustrates a perspective view of an initial preferred embodiment of a modular rail and post fence system 10 constructed in accordance with the present invention wherein the component elements (to be described herein in detail) have been assembled and the modular fence system 10 has been fully installed.

The system 10 includes a plurality of rail assemblies 12, 14, 16, 18, 20 and 22, each of which are similar in construction.

The modular rail and post fence system 10 also includes a plurality of elongated posts 24 and 26. As in normal fence system installation, one end of each of the elongated posts 24 and 26 is buried in the ground 35 while the opposing end may be covered with caps 28 and 30, respectively.

The fence system 10 of the present invention may be designed so that existing post caps may be utilized with the present invention.

A pair of rail assemblies, such as 16 and 18, extend between adjacent posts 24 and 26, although a greater or lesser number of rail assemblies might be employed.

Figure 2:
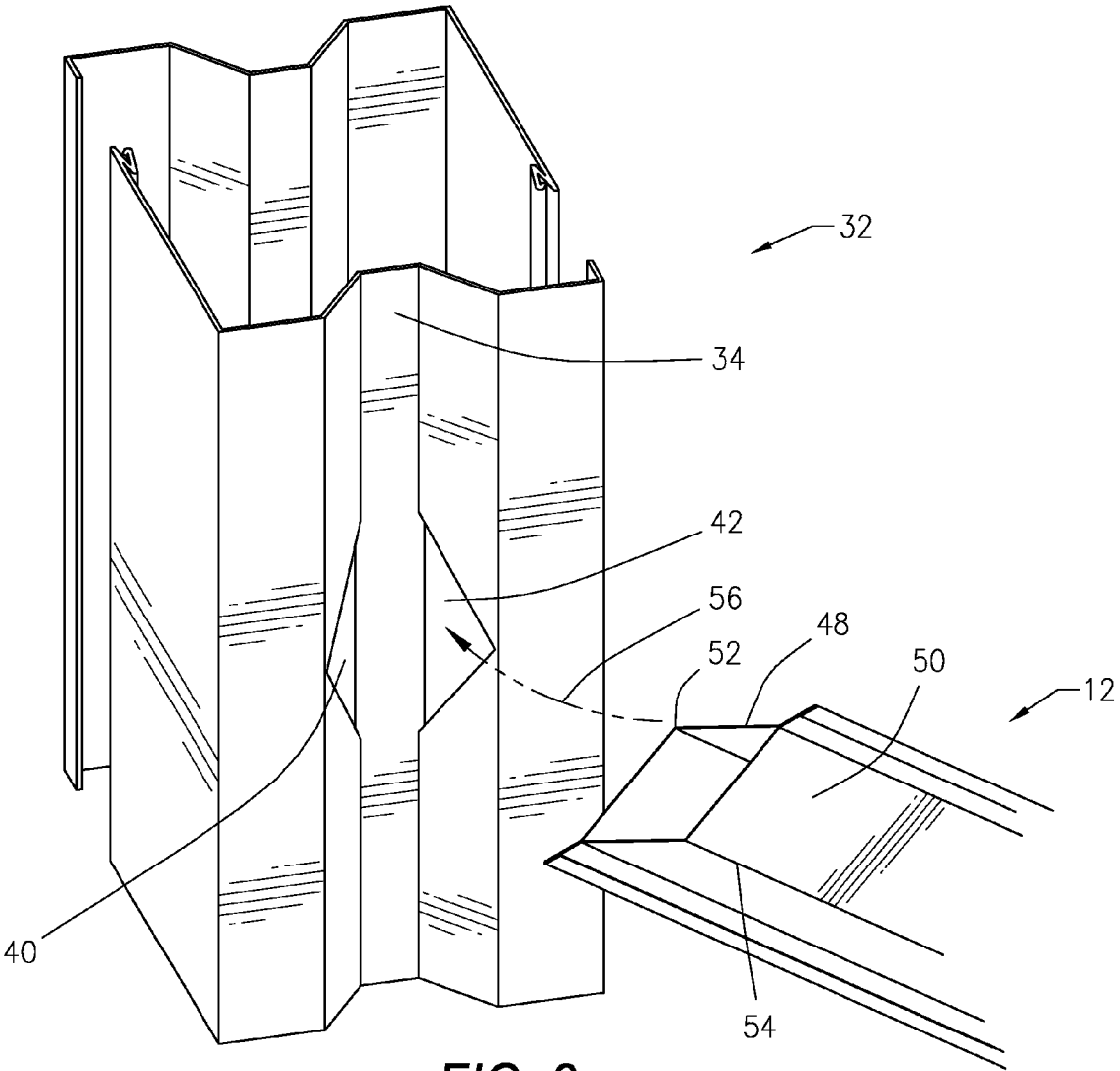
FIG. 2 is a perspective view of a rail assembly formed together from a pair of rail panels adjacent to an elongated post prior to receipt of an end of the rail assembly in the elongated post in accordance with the present invention.

FIG. 2 illustrates a perspective view of a portion of an elongated fence post 32 adjacent to a rail assembly 12 prior to installation. The elements of the post (to be described) are shown prior to assembly. The elongated post 32 includes a longitudinal recess 34 which, in a preferred embodiment, extends the entire length of the elongated post 32. In a preferred embodiment, each recess is wider at the face of the post so that the recess is tapered. The elongated post 32 may be roll formed from flat metal in various ways as will be described herein.

At spaced positions in the longitudinal recess 34 along the elongated post 32, pairs of opposed notches are provided. As will be explained in detail, the pairs of notches form the mechanism to retain the rail assemblies in position with respect to the elongated posts. In one embodiment, seven pairs of notches are provided in each elongated post to allow selective placement of the rail assemblies.

One pair of notches 40 and 42 are visible in the longitudinal recess 34. In a preferred embodiment, each notch is triangular in shape.

The rail assembly 12 is formed from a pair of rail panels 48 and 50. Each rail panel 48 and 50 has a pair of flat sidewalls which are joined together at an angle to form an obtuse angled edge, such as shown at 52 and 54, respectively. The rail assembly 12 is tubular with a hollow interior. Once assembled, each rail assembly is slightly compressible and resilient. A clamp (not shown) may be used to compress the rail assembly during installation and insertion of the rail assembly into the notches. The obtuse angled edges 52 and 54 of the rail assembly will be received in the triangular notches 40 and 42 of the post, as suggested by arrow 56.

One rail panel 48 has a first end terminating in an opening having a hook and an opposed second end terminating in an opening having a hook. The other rail panel 50 has opposed ends terminating in flat edges. The rail panel 50 is inserted into the panel 48 to form the rail assembly 12. It will be appreciated that each rail panel may be fabricated by roll forming flat metal sheets.

Figure 3:
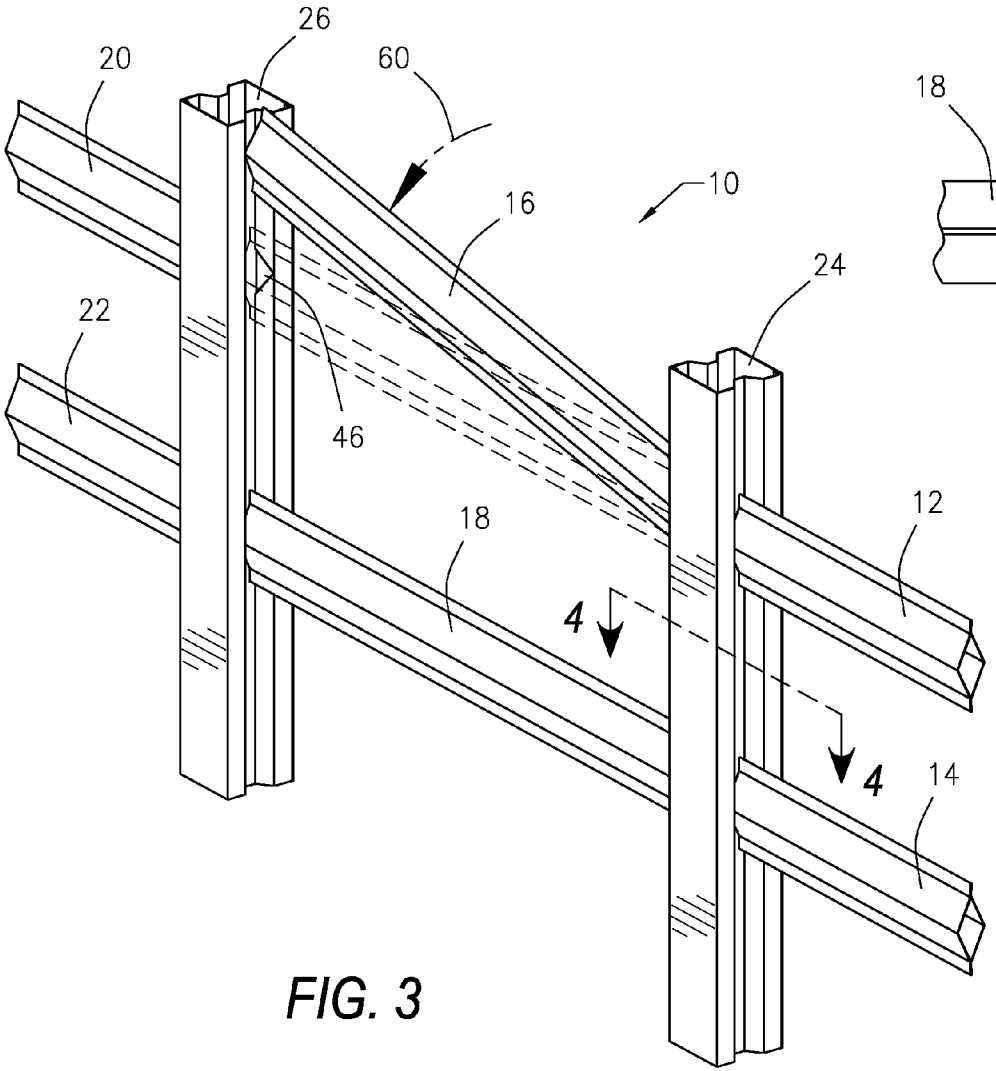
FIG. 3 illustrates an assembled elongated post along with a pair of rail assemblies.

FIG. 3 illustrates the modular fence system 10 partially installed and the sequential installation technique and procedure for installing a rail assembly 16 into the longitudinal recess of an elongated post 26. Initially the posts 26 and 24 are installed in the ground spaced from each other. The elongated post 26 includes a longitudinal recess running the length of the post with a pair of opposed notches 44 and 46 (notch 46 visible in FIG. 3).

As shown in FIG. 3, one end of the rail assembly 16 has already been inserted into the longitudinal recess (not visible) in post 24 and locked in place. In order to complete the installation, the opposite end of the rail assembly 16 is inserted into the longitudinal recess of post 26. As depicted by arrow 60, the rail assembly 16 is rotated downward until it snap fits into the notches 44 and 46 of the longitudinal recess of post 26. The same process is repeated until all of the rail assemblies are inserted.

Figure 4:
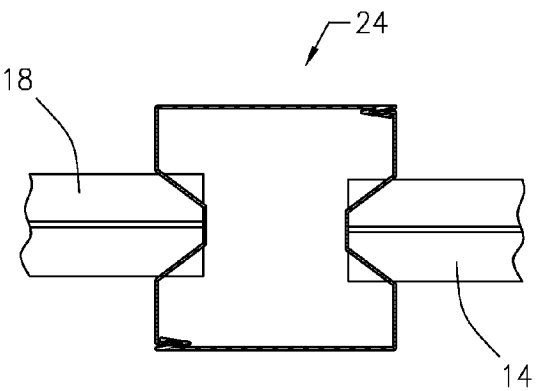
FIG. 4 illustrates a sectional view taken along section line 4-4 of FIG. 3.

FIG. 4 is a sectional view taken along section line 4-4 of FIG. 3 with the rail assemblies 18 and 14 fully installed in the notches of the longitudinal recesses of elongated post 24.

Figure 6:
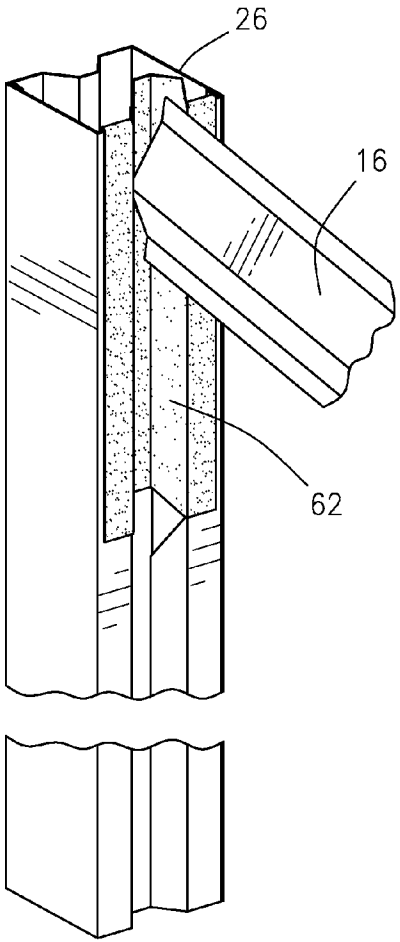
FIGS. 5 and 6 illustrate sequential views of installation of a rail assembly with an elongated post.
Figure 5:
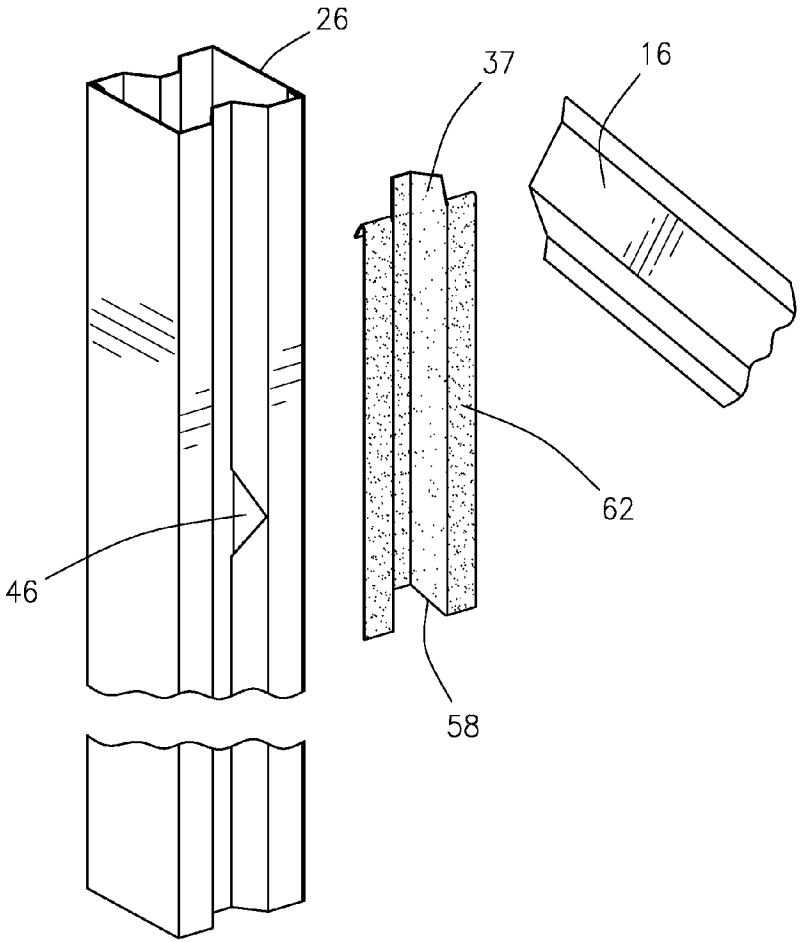

FIGS. 5 and 6 show a portion of the elongated fence post 26 and a portion of the rail assembly 16 apart from the fence post system 10 prior to installation. FIGS. 5 and 6 show an optional sequential installation of a rail assembly 16 to the post 26.

An optional installation post protector 62 may be fabricated from a smooth material, such as plastic. The installation post protector 62 is brought up adjacent and against the elongated post 26. The installation post protector 62 has a recess 37 which conforms to the longitudinal recess of the post 26. The post protector 62 also has a notch 58 which correspond with the notch in the post 26. Once the post protector 62 has been aligned with and against the post 26, the rail assembly 16 may be moved downward within the longitudinal recess so that the end of the rail assembly 16 slides along the post protector 62. The rail assembly 16 will move downward until the end of the rail assembly 16 engages with and resides in the pair of notches 44 and 46 in the recess of the post 30. Thereafter, the installation post protector 62 may be withdrawn and removed.

As a further option, a rotatable adapter (not shown) may be used to connect an end of the rail assembly with the notches of the post. One end of the rotatable adapter would be inserted into the open end of the rail assembly and the other end of the adapter would engage the pair of notches.

Figure 7:
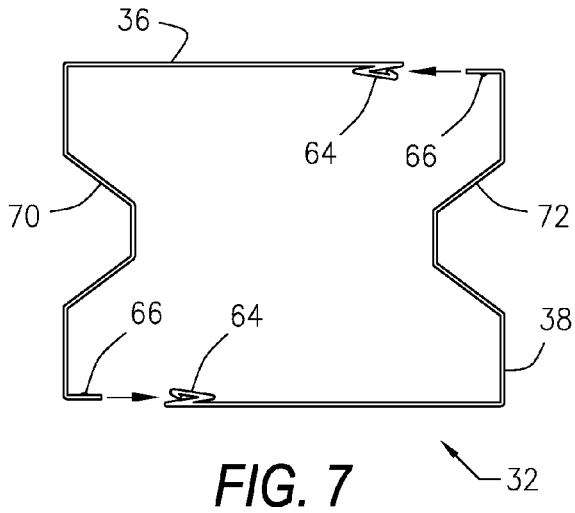
FIGS. 7 and 8 illustrate sequential views of assembly of one configuration of an elongated post.
Figure 8:
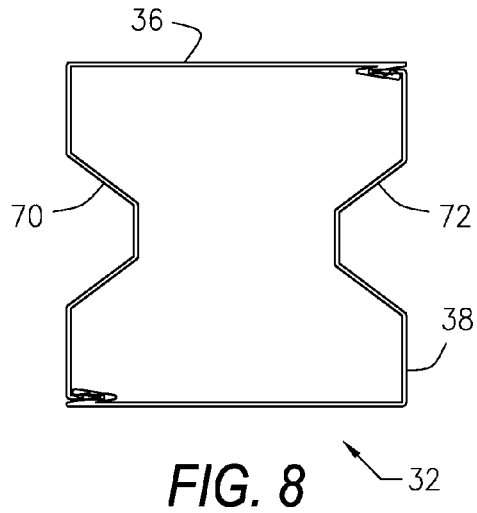
Figure 9:
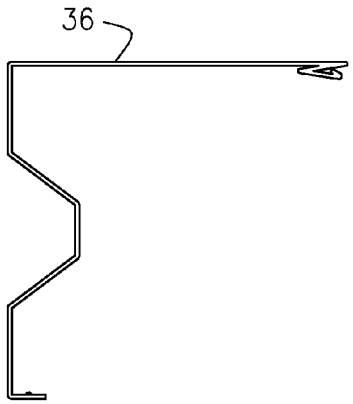
FIGS. 9 through 12 illustrate four different post components.
Figure 10:
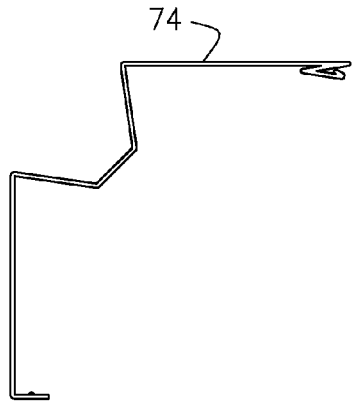
Figure 11:
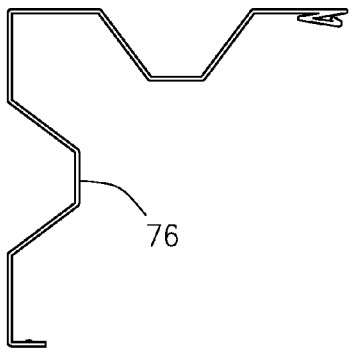
Figure 12:
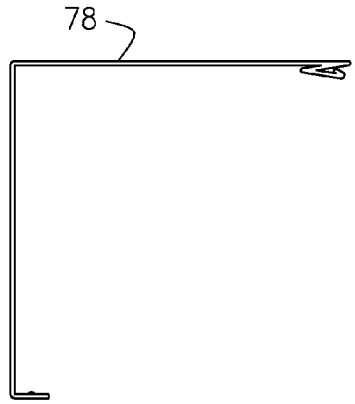

FIGS. 7 and 8 illustrate the components of one preferred configuration of an elongated post, such as elongated post 32. The elongated post 32 is composed of a pair of elements 36 and 38 which are identical to each other. The post elements 36 and 38 are shown apart from each other prior to assembly in FIG. 7 and are shown fully assembled in FIG. 8. Each post element 36 and 38 includes a longitudinal recess 70 and 72 which is tapered so that each recess is wider at the face of the post.

Each of the post elements 36 and 38 may be initially formed from flat metal panels or formed in any alternate manner.

Each of the post elements 36 and 38 includes a first end which terminates in a crimp to form an opening having a hook 64 and a second end terminating in one or more button protrusions 66. The post 32 is assembled by inserting one end of one element with the button protrusion 66 into the opposed element so that the button protrusions 66 are trapped in the hooks 64 to prevent the posts from coming apart. As seen in FIG. 8, the assembled post 32 is tubular with a hollow interior.

Figure 13:
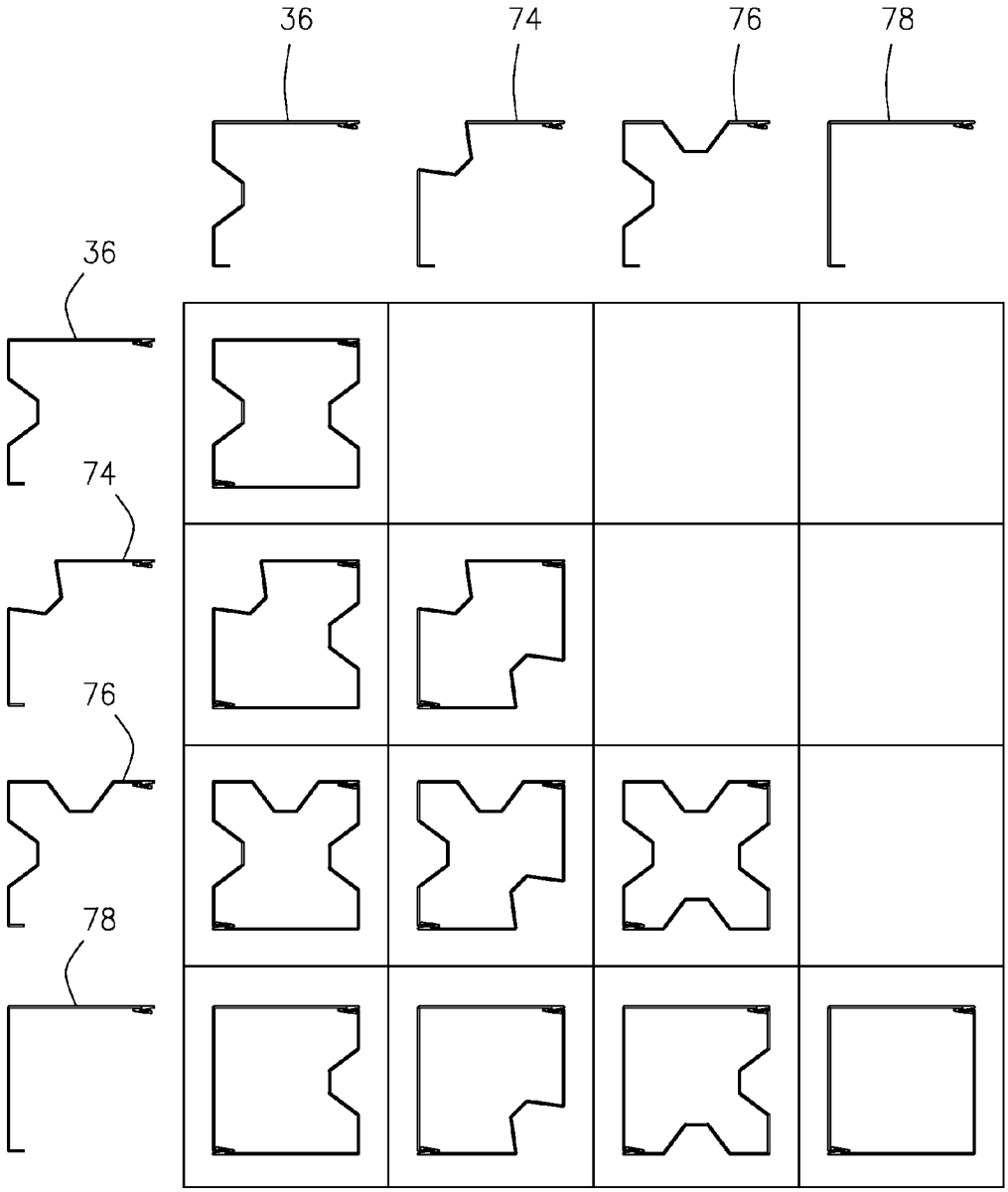
FIG. 13 illustrates the four different post components shown, in FIGS. 9 through 12 combined to form up to ten different post configurations.

FIGS. 9, 10, 11 and 12 show alternate configurations of post elements with each post element forming half of the post. Alternate configurations are shown in post elements 74, 76 and 78. As illustrated in the chart shown in FIG. 13, the four post elements 36, 74, 76 and 78 may be combined to form up to ten different post configurations.

Figure 14:
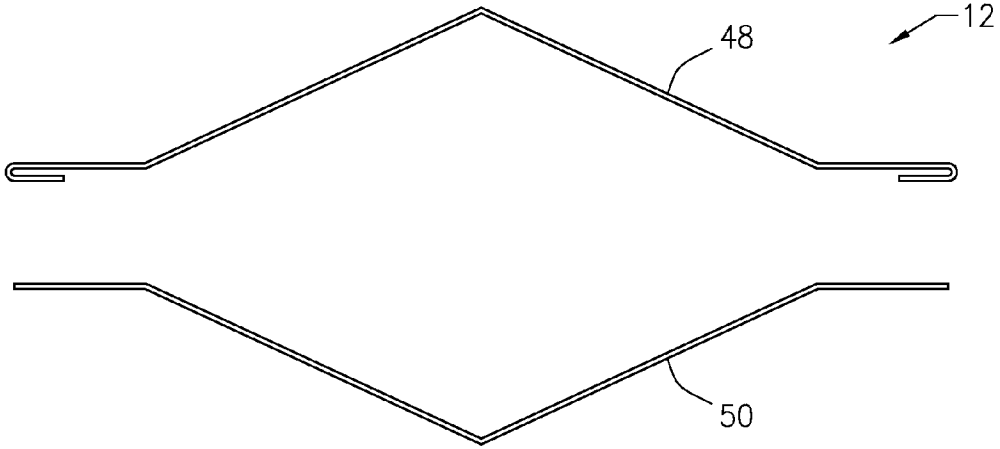
FIG. 14 is an exploded view of a rail assembly as shown in FIGS. 1 and 2.

FIG. 14 illustrates an exploded end view of one rail assembly 12 having a first rail panel 48 and a second rail panel 50 prior to assembly.

Figure 15:
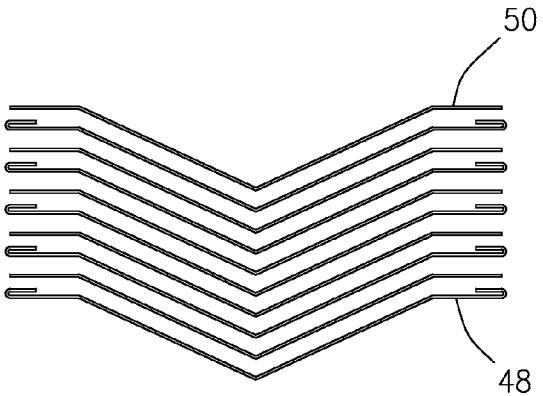
FIGS. 15 and 16 show components of the fence system nested together for shipping and storage.
Figure 16:
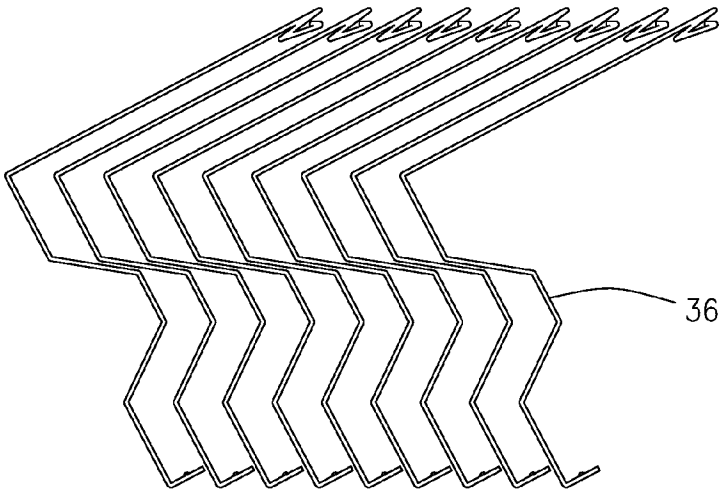

FIGS. 15 and 16 show components of the fence system 10 nested together for storage and shipment prior to assembly. The various components may be stored and also shipped to a site in nested condition for assembly which takes up less space than traditional fence components.

Figure 17:
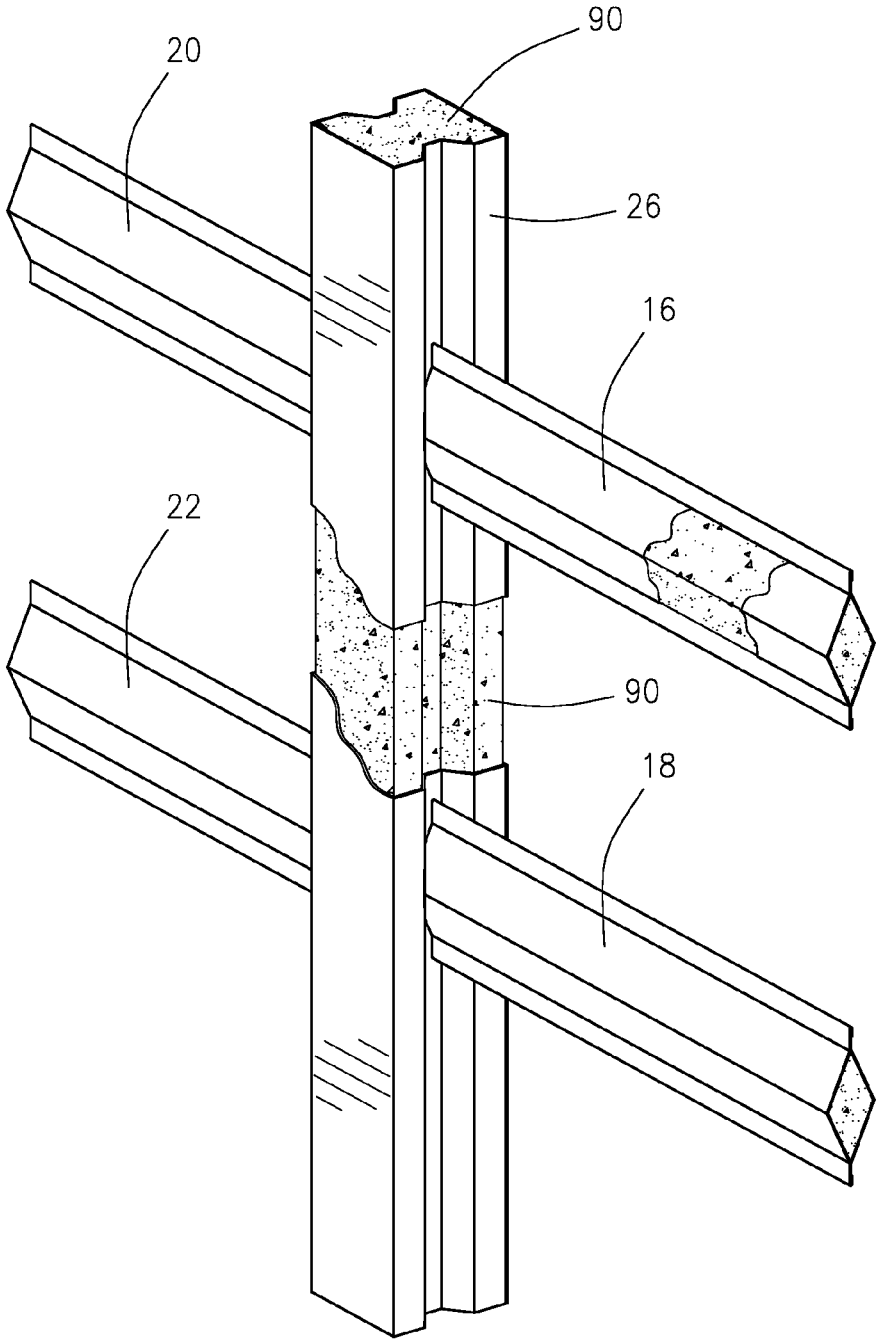
FIG. 17 illustrates a perspective view of an elongated post and rail assembly filled with an initially liquid material cured to a solid.

FIG. 17 illustrates an optional feature of the present invention. Either before or once the rail assemblies and elongated posts have been installed, an initial liquid material may be inserted or pumped into the hollow interiors of the rail assemblies and elongated posts. An appropriate known pump and gun or nozzle may be utilized. The initially liquid material will be chosen so that it will cure or dry to a solid 90 to provide structural integrity to the fence system. FIG. 17 shows the post 26 and rail assembly 16 partially cut-away to reveal the material after curing to a solid 90.

Figure 18:
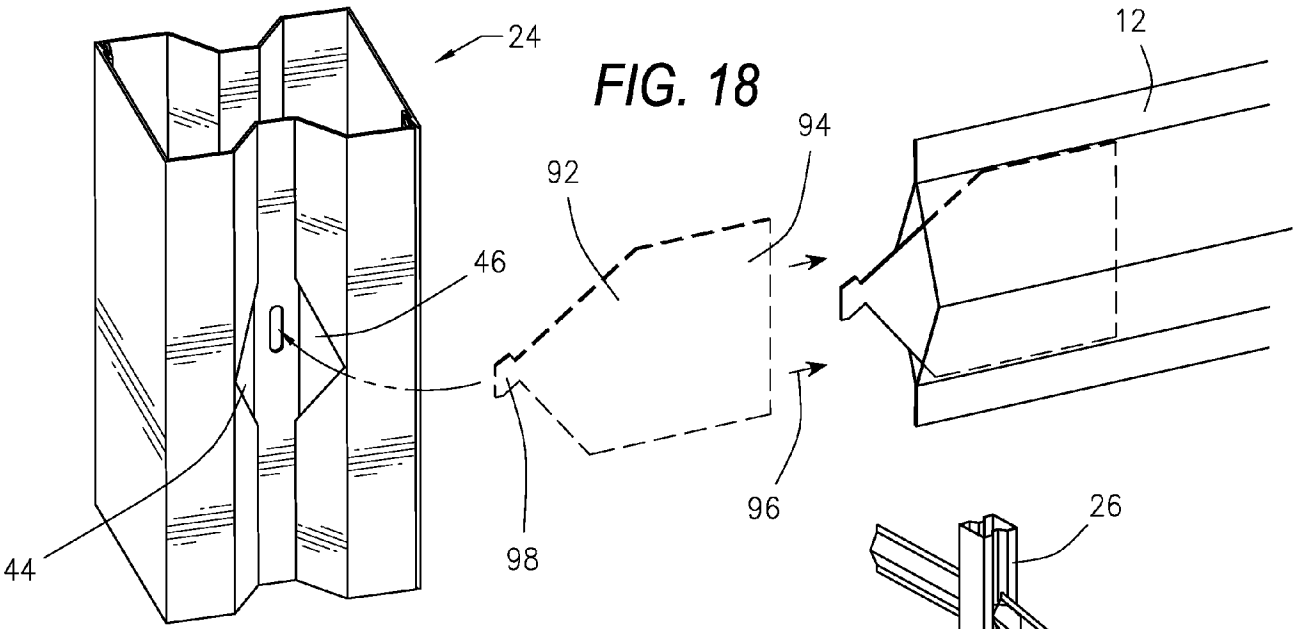
FIGS. 18 and 19 illustrate a further optional feature of the present invention.
Figure 19:
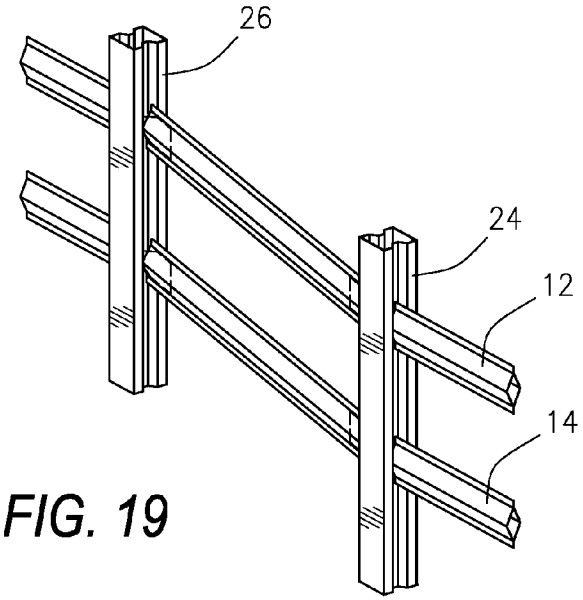

FIGS. 18 and 19 illustrate a further optional feature of the present invention. The longitudinal recesses in the posts, such as post 24, will include between the opposed notches 44 and 46 if a rotatable adapter 92 has a pair of opposed ends. A first end 94 is inserted into an open end of the rail assembly as illustrated by arrows 96. The opposed end 98 of the adapter 92 extends from the rail assembly. The opposed end 98 is received in the slot between the opposed notches 44 and 46. In the event of field conditions, such as uneven terrain, the adapter 92 will connect and retain the rail assembly to the post.

Whereas, the present invention has been described in relation to the drawings attached hereto, it should be understood that other and further modifications, apart from those shown or suggested herein, may be made within the spirit and scope of this invention.

What is claimed is:

1. A process to produce a rail and post fence system which comprises:

forming a pair of rail panels from flat metal wherein each rail panel has a pair of sidewalls joined together at an angle to form an angled edge;

joining said pair of rail panels together to form a rail assembly;

forming an elongated post having a longitudinal recess;

providing at least one pair of notches in said longitudinal recess;

inserting an end of said rail assembly into said recess until each said angled edge resides in one of said notches.

2. A process to produce a rail and post fence system as set forth in claim 1 wherein said elongated post is composed of a pair of post panels formed from flat metal.

3. A process to produce a rail and post fence system as set forth in claim 2 wherein post panels are selectively chosen from a group of panels to form a wide variety of post configurations.

4. A process to produce a rail and post fence system as set forth in claim 1 including the additional step of inserting an initially liquid material which cures to solid in said rail assembly and said elongated post.

5. A process to produce a rail and post fence system as set forth in claim 1 wherein each notch in said pair of notches is triangular.

6. A process to produce a rail and post fence system as set forth in claim 5 wherein said step of joining said pair of rail panels together to form a rail assembly is accomplished by inserting said second end of one said rail panel into said first end of another said rail panel.

7. A process to produce a rail and post fence system as set forth in claim 1 wherein each said rail panel has a first end and a second end.

8. A process to produce a rail and post fence system as set forth in claim 1 including an additional step prior to said step of joining said pair of rail panels together of nesting said rail panels together for storage and shipping.

9. A process to produce a rail and post fence system as set forth in claim 1 including holding a post protector against said elongated post while inserting said end of said rail assembly into said recess.

10. A process to produce a rail and post fence system which comprises:

forming a pair of rail panels from flat metal wherein each rail panel has a pair of sidewalls joined together at an angle to form an angled edge;

joining said pair of rail panels together to form a rail assembly;

forming an elongated post having a longitudinal recess;

providing at least one pair of notches in said longitudinal recess; and connecting an end of said rail assembly with said pair of notches.

11. A process to produce a rail and post fence system as set forth in claim 10 wherein each said elongated post is composed of a pair of post panels formed from flat metal.

12. A process to produce a rail and post fence system as set forth in claim 10 wherein said end of said rail assembly receives a first end of a rotatable adaptor and wherein an opposed end of said rotatable adaptor is received in a slot in said elongated post between said pair of notches.

* * * * *